US009243628B2

(12) United States Patent
Villareal et al.

(10) Patent No.: US 9,243,628 B2
(45) Date of Patent: Jan. 26, 2016

(54) ADAPTIVE PUMP CONTROL FOR POSITIVE DISPLACEMENT PUMP FAILURE MODES

(71) Applicant: Schlumberger Technology Corporation, Sugar Land, TX (US)

(72) Inventors: Steven Villareal, Cheltenham (GB); Julian J. Pop, Houston, TX (US); Albert Hoefel, Sugar Land, TX (US); Kent David Harms, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/269,743

(22) Filed: May 5, 2014

(65) Prior Publication Data

US 2014/0244049 A1 Aug. 28, 2014

Related U.S. Application Data

(63) Continuation of application No. 13/184,684, filed on Jul. 18, 2011, now Pat. No. 8,757,986.

(51) Int. Cl.
*F04B 49/22* (2006.01)
*F04B 49/00* (2006.01)
(Continued)

(52) U.S. Cl.
CPC ..... *F04B 49/22* (2013.01); *E21B 49/10* (2013.01); *F04B 19/22* (2013.01); *F04B 47/00* (2013.01); *F04B 47/02* (2013.01); *F04B 49/00* (2013.01); *F04B 2201/0201* (2013.01); *F04B 2201/0603* (2013.01)

(58) Field of Classification Search
CPC ..... F04B 47/00; F04B 49/22; F04B 19/22; F04B 2201/0201; F04B 2201/0603; F04B 9/00
USPC ..... 417/53, 56–58, 63, 242, 386, 390, 401, 417/404, 555.1, 555.2; 166/68, 105, 108
See application file for complete search history.

(56) References Cited

U.S. PATENT DOCUMENTS 4,705,459 A 11/1987 Buisine et al.
5,743,716 A 4/1998 Smith
(Continued)

FOREIGN PATENT DOCUMENTS

EA 015138 B1 6/2011
EP 0264148 A1 4/1988
(Continued)

OTHER PUBLICATIONS

European Search Report for EP Application No. 12815547.0 dated Dec. 1, 2015.

*Primary Examiner* — Peter J Bertheaud
*Assistant Examiner* — Dominick L Plakkoottam
(74) *Attorney, Agent, or Firm* — Kenneth L. Kincaid

(57) ABSTRACT

Detecting a failure mode of a fluid flow controller configured to control fluid flow between first and second chambers of a downhole positive displacement pump and a flow line, wherein the positive displacement pump comprises a piston moving in an axial reciprocating motion, and subsequently adjusting operation of the downhole positive displacement pump based on the detected failure mode such that the downhole positive displacement pump piston operates differently in different axial directions.

15 Claims, 5 Drawing Sheets

(51) Int. Cl.

| | |
|---|---|
| ***F04B 47/00*** | (2006.01) |
| ***E21B 49/10*** | (2006.01) |
| ***F04B 19/22*** | (2006.01) |
| ***F04B 47/02*** | (2006.01) |

(56) References Cited

U.S. PATENT DOCUMENTS

| | | | | |
|---|---|---|---|---|
| 5,799,733 | A | 9/1998 | Ringgenberg et al. | |
| 6,237,404 | B1 | 5/2001 | Crary et al. | |
| 6,543,544 | B2 | 4/2003 | Schultz et al. | |
| 6,568,487 | B2 | 5/2003 | Meister et al. | |
| 6,923,052 | B2 | 8/2005 | Krueger et al. | |
| 7,124,819 | B2 | 10/2006 | Ciglenec et al. | |
| 7,216,533 | B2 | 5/2007 | McGregor et al. | |
| 7,222,524 | B2 | 5/2007 | Shammai | |
| 7,234,521 | B2 | 6/2007 | Shammai et al. | |
| 7,395,703 | B2 | 7/2008 | Niemeyer et al. | |
| 7,594,541 | B2 | 9/2009 | Ciglenec et al. | |
| 7,665,354 | B2 | 2/2010 | Shammai | |
| 7,805,247 | B2 | 9/2010 | Hsu et al. | |
| 7,967,081 | B2 | 6/2011 | Sugiura et al. | |
| 8,004,421 | B2 | 8/2011 | Clark | |
| 8,111,171 | B2 | 2/2012 | Clark | |
| 8,121,788 | B2 | 2/2012 | Bordakov et al. | |
| 8,302,689 | B2 | 11/2012 | van Zuilekom et al. | |
| 8,366,402 | B2 * | 2/2013 | St. Michel et al. | 417/63 |
| 8,424,596 | B2 | 4/2013 | Bebb | |
| 8,429,962 | B2 | 4/2013 | Zazovsky et al. | |
| 8,502,696 | B2 | 8/2013 | Clark | |
| 8,757,986 | B2 | 6/2014 | Villareal et al. | |
| 2004/0117132 | A1 | 6/2004 | Stephenson et al. | |
| 2004/0158419 | A1 | 8/2004 | Pearson et al. | |
| 2005/0022589 | A1 | 2/2005 | Du | |
| 2005/0132877 | A1 * | 6/2005 | Hart | 91/509 |
| 2006/0174757 | A1 * | 8/2006 | Iwase et al. | 91/465 |
| 2008/0156486 | A1 * | 7/2008 | Ciglenec et al. | 166/264 |
| 2009/0047153 | A1 * | 2/2009 | Best | 417/415 |
| 2010/0006341 | A1 | 1/2010 | Downton | |
| 2010/0175925 | A1 | 7/2010 | Ciglenec et al. | |
| 2010/0201540 | A1 | 8/2010 | Li et al. | |
| 2011/0114310 | A1 | 5/2011 | Ross et al. | |
| 2011/0198077 | A1 | 8/2011 | Kischkat et al. | |
| 2011/0276187 | A1 | 11/2011 | Ciglenec et al. | |
| 2012/0013481 | A1 | 1/2012 | Clark | |
| 2012/0014219 | A1 | 1/2012 | Clark | |
| 2012/0132305 | A1 * | 5/2012 | Conley | 137/565.17 |
| 2012/0145462 | A1 | 6/2012 | Leising et al. | |
| 2012/0152533 | A1 | 6/2012 | Hoefel et al. | |
| 2012/0160563 | A1 | 6/2012 | Clark et al. | |
| 2012/0160565 | A1 | 6/2012 | Downton et al. | |
| 2013/0014576 | A1 | 1/2013 | Pelletier | |
| 2013/0022476 | A1 | 1/2013 | Villareal et al. | |
| 2013/0047696 | A1 | 2/2013 | Rasmus et al. | |
| 2013/0048380 | A1 | 2/2013 | Rasmus et al. | |
| 2013/0054146 | A1 | 2/2013 | Rasmus et al. | |
| 2013/0090854 | A1 | 4/2013 | Rasmus et al. | |
| 2013/0090855 | A1 | 4/2013 | Rasmus et al. | |
| 2013/0204534 | A1 | 8/2013 | Anand et al. | |
| 2013/0301389 | A1 | 11/2013 | Alford et al. | |

FOREIGN PATENT DOCUMENTS

| | | | |
|---|---|---|---|
| WO | 9321442 | A1 | 10/1993 |
| WO | 2007072385 | A2 | 6/2007 |
| WO | 2008153698 | A1 | 12/2008 |
| WO | 2013012832 | A2 | 1/2013 |

* cited by examiner

ADAPTIVE PUMP CONTROL FOR POSITIVE DISPLACEMENT PUMP FAILURE MODES

CROSS-REFERENCE TO RELATED APPLICATIONS

This application is a continuation of and claims priority to U.S. patent application Ser. No. 13/184,684, entitled "Adaptive Pump Control for Positive Displacement Pump Failure Modes," filed Jul. 18, 2011, now U.S. Pat. No. 8,757,986, the entire disclosure of which is hereby incorporated herein by reference.

BACKGROUND OF THE DISCLOSURE

Wells are generally drilled into the ground or ocean bed to recover natural deposits of oil and gas, as well as other desirable materials that are trapped in geological formations in the Earth's crust. Wells are typically drilled using a drill bit attached to the lower end of a drill string. Drilling fluid, or mud, is typically pumped down through the drill string to the drill bit. The drilling fluid lubricates and cools the drill bit, and may additionally carry drill cuttings from the borehole back to the surface.

Reservoir production and testing may involve drilling wells and monitoring various subsurface formation parameters. When drilling and monitoring, downhole tools having electric, mechanical, and/or hydraulic powered devices may be used. In some implementations, pump systems may be used to draw and pump formation fluid from subsurface formations. A downhole string (e.g., a drill string, coiled tubing, slickline, wireline, etc.) may include one or more pump systems depending on the operations to be performed using the downhole string, or the string may have fluids pumped therein from a surface of the formation.

One such pump system is a positive displacement pump. A positive displacement pump causes a fluid to move by trapping a fixed amount of it then forcing (displacing) that trapped volume through a discharge. Such a pump system usually produces the same flow at a given speed (RPM) regardless of the discharge pressure.

Commonly, multiple moving parts involved in any formation testing tool, such as pump systems in either wireline or measurement-while-drilling (MWD) tools, can result in equipment failure or less than optimal performance. Further, at significant depths, substantial hydrostatic pressure and high temperatures are experienced, thereby further complicating matters. Still further, formation testing tools are operated under a wide variety of conditions and parameters that are related to both the formation and the drilling conditions.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
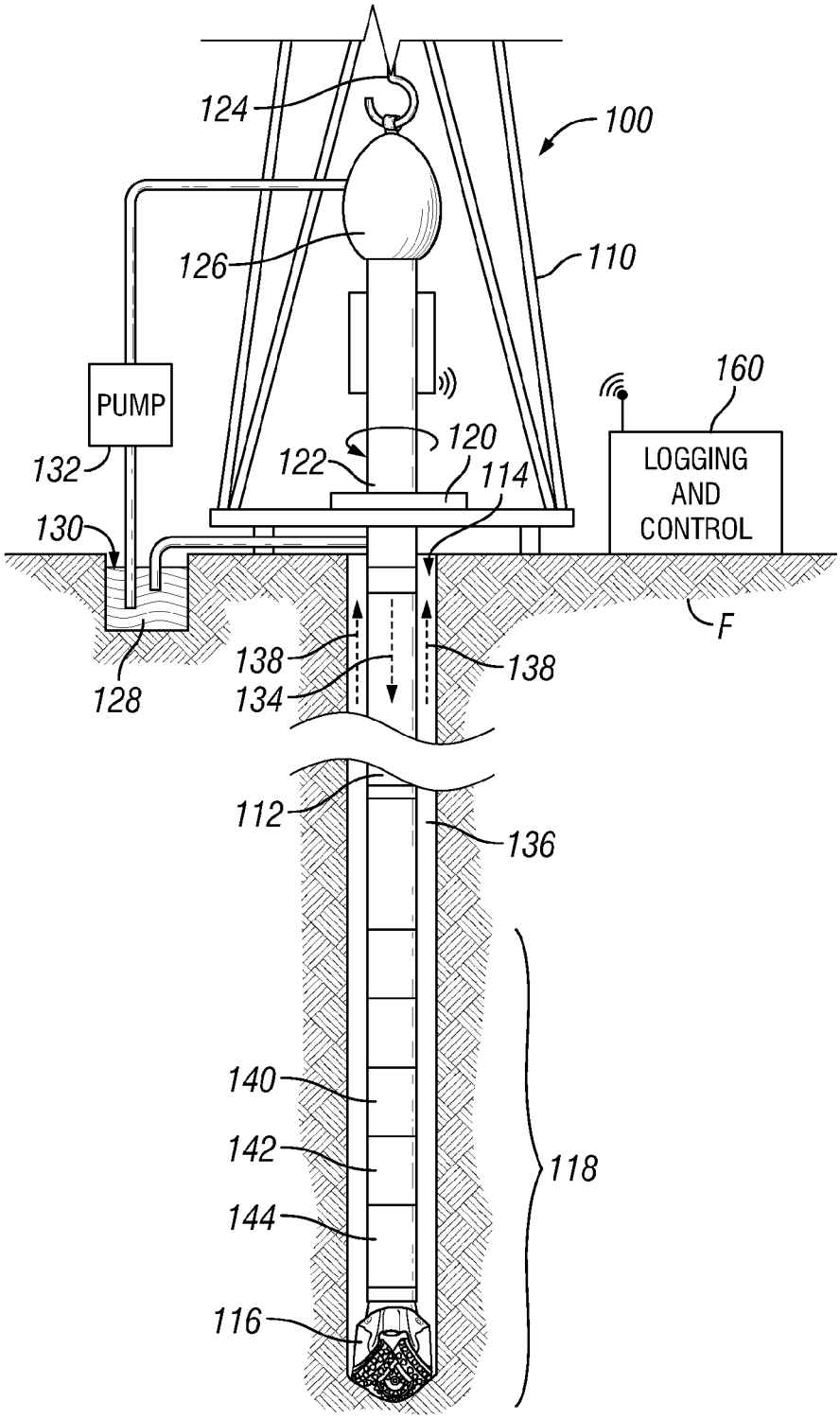
FIG. 1 is a schematic view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure relate to methods and apparatus for identification and mitigation of common failure modes in formation sampling tools. For example, one or more aspects of the present disclosure relate to detecting and compensating for failure modes in downhole pump systems, such as in a positive displacement pump, used to produce fluid from or inject fluid into a fluid flow line that may be operatively connected to a subterranean formation, an inflatable packer, or a hydraulic actuator, among other uses.

When a multi-chamber positive displacement pump is used to produce fluid from or inject fluid into subterranean formations, a fluid flow controller is used to control fluid flow between the pump chambers and the formation. Often times, such a multi-chamber positive displacement pump changes its behavior during operation, resulting in one or more failure modes of the positive displacement pump. For example, failure modes may include failure of a fluid flow controller due to clogging of the fluid flow controller in an open position, sand accumulation in one or more chambers of the positive displacement pump, or any combination thereof.

One or more aspects of the present disclosure provide a pumping strategy for automatically and/or externally detecting one or more failure modes of a downhole positive displacement pump. Detection of the failure modes may be performed using a combination of sensor measurements and pattern recognition techniques. Such detection may result in a more accurate report of the volume of fluid effectively drawn or otherwise pumped by the positive displacement pump, leading to more accurate calculations for contamination analysis and prediction of the time to reach a target contamination level. Further, one or more aspects of the present disclosure provide for compensation of the detected failure mode(s). Compensation may be applied by changing one or more parameters of pump operation, such as, for example, the operating rate of the positive displacement pump.

FIG. 1 depicts a wellsite system including a downhole tool(s) which may be configured according to one or more aspects of the present disclosure. The wellsite drilling system of FIG. 1 can be employed onshore and/or offshore. In the example wellsite system of FIG. 1, a borehole 114 is formed in one or more subsurface formations by rotary and/or directional drilling.

As illustrated in FIG. 1, a drillstring 112 is suspended from a drill rig 110 in the borehole 114 and includes a bottom hole assembly (BHA) 118 having a drill bit 116 at its lower end. A surface system includes a platform and derrick assembly 100 positioned over the borehole 114. The derrick assembly 100 includes a rotary table 120, a kelly 122, a hook 124 and a rotary swivel 126. The drillstring 112 is rotated by the rotary table 120, energized by means not shown, which engages the kelly 122 at an upper end of the drillstring 112. The example drillstring 112 is suspended from the hook 124, which is attached to a traveling block (not shown), and through the kelly 122 and the rotary swivel 126, which permits rotation of the drillstring 112 relative to the hook 124. Additionally, or alternatively, a top drive system could be used.

In the example depicted in FIG. 1, the surface system further includes drilling fluid 128, which is commonly referred to in the industry as "mud," and which is stored in a pit 130 formed at the well site. A pump 132 delivers the drilling fluid 128 to the interior of the drillstring 112 via a port in the rotary swivel 126, causing the drilling fluid 128 to flow downwardly through the drillstring 112 as indicated by the directional arrow 134. The drilling fluid 128 exits the drillstring 112 via ports in the drill bit 116, and then circulates upwardly through the annulus region 136 between the outside of the drillstring 112 and the wall of the borehole 114, as indicated by the directional arrows 138. The drilling fluid 128 lubricates the drill bit 116, carries formation cuttings up to the surface as it is returned to the pit 130 for recirculation, and creates a mudcake layer (not shown) on the walls of the borehole 114.

The example bottom hole assembly 118 of FIG. 1 includes, among other things, any number and/or type(s) of logging-while-drilling (LWD) modules or tools (one of which is designated by reference numeral 140) and/or measuring-while-drilling (MWD) modules (one of which is designated by reference numeral 142), a rotary-steerable system or mud motor 144 and the example drill bit 116. The MWD module 142 measures the azimuth and inclination of the bottom hole assembly 118 that may be used to monitor the borehole trajectory.

The example LWD tool 140 and/or the example MWD module 142 of FIG. 1 may be housed in a special type of drill collar, as it is known in the art, and contains any number of logging tools and/or fluid sampling devices. The example LWD tool 140 includes capabilities for measuring, processing and/or storing information, as well as for communicating with the MWD module 142 and/or directly with the surface equipment, such as, for example, a logging and control computer 160.

The logging and control computer 160 may include a user interface that enables parameters to be input and/or outputs to be displayed that may be associated with the drilling operation and/or the formation traversed by the borehole 114. While the logging and control computer 160 is depicted uphole and adjacent the wellsite system, a portion or all of the logging and control computer 160 may be positioned in the bottom hole assembly 118 and/or in a remote location.

Figure 2:
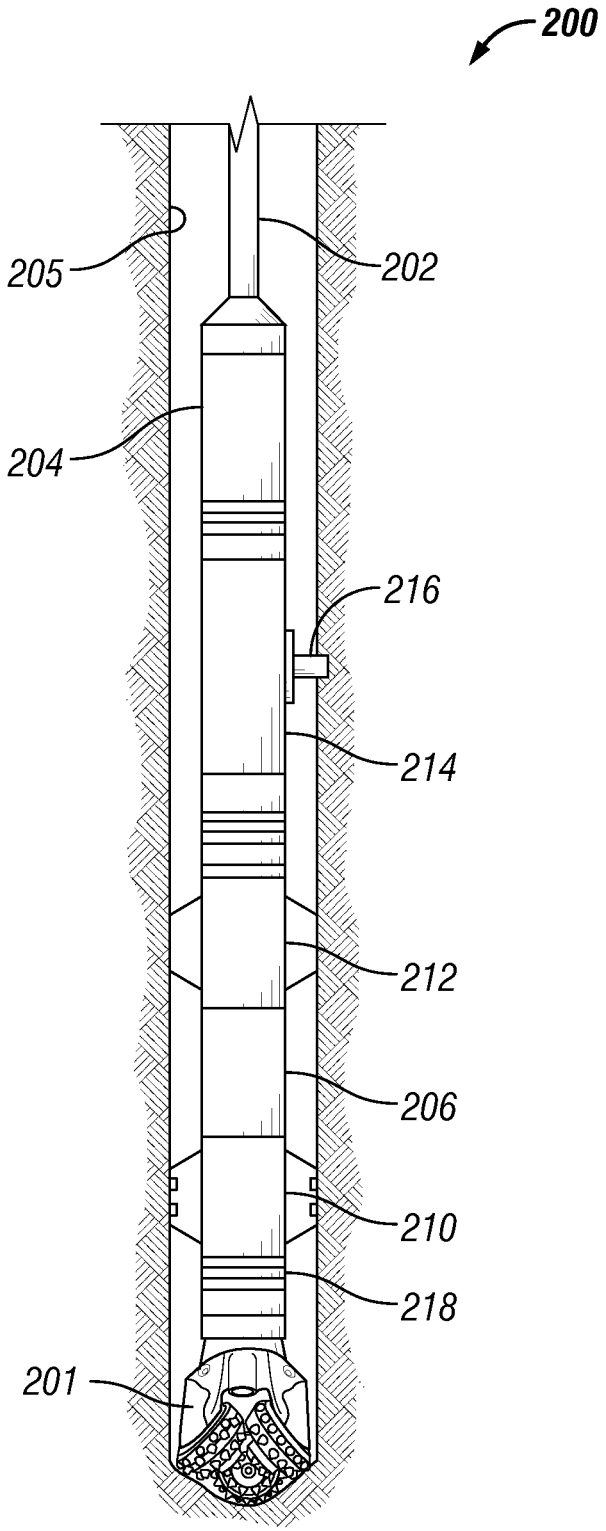
FIG. 2 is a schematic view of an apparatus according to one or more aspects of the present disclosure.

Referring to FIG. 2, illustrated is a schematic view of a bottom hole assembly ("BHA") 200 attached at the end of a drill string 202 in a borehole 205 according to one or more aspects of the present disclosure. The BHA 200 comprises a "while drilling" formation sampling tool 214 having an extendable probe 216. The extendable probe 216 of the formation sampling tool 214 may be fluidly coupled to a positive displacement pump (not shown). The formation sampling tool 214 shown in FIG. 2 is configured to obtain fluid samples.

The drill string 202 comprises a central bore therethrough to circulate drilling fluid or mud from the surface towards a drill bit 201. Pressure pulses may be generated in the drilling fluid column inside the drill string 202 to convey signals (encoding data and/or commands) between a surface system (not shown) and various tools or components in the BHA 200. Alternatively, or additionally, the drill string 202 may comprise wired drill pipe.

In addition to the formation sampling tool 214, the BHA 200 may comprise a drill bit 201, a near wellbore imaging tool 210, a directional drilling sub 206, a lithology analysis tool 212, and/or a measurement ("MWD") tool 204. The MWD tool 204 may comprise a mud turbine generator (not shown) powered by the flow of the drilling fluid and/or battery systems (not shown) for generating electrical power to components in the BHA 200. The MWD tool 204 may also comprise capabilities for communicating with surface equipment. The MWD tool 204 also comprises one or more devices or sensors or measuring or detecting weight-on-bit, torque, vibration, shock, stick-slip, direction (e.g., a magnetometer), inclination (e.g., an accelerometer), and/or gamma rays.

The near wellbore imaging tool 210 may comprise one or more current-measuring electrodes. The current may be generated in the BHA 200 by a coil 218 of the near wellbore imaging tool 210. The current may then exit the BHA 200 (e.g., at the drill bit 201) and may return to the BHA 200 through the one or more electrodes of the near wellbore imaging tool 210. The current at the electrodes may be measured as the BHA 200 is disposed within the formation for drilling, as the BHA 200 is rotated within the formation, and/or as the BHA 200 is tripped out of the formation. Thus, resistivity images of the formation may be generated from data collected by the near wellbore imaging tool 210, such as with relation to the wellbore depth and/or the BHA 200 orientation within the wellbore.

Figure 3:
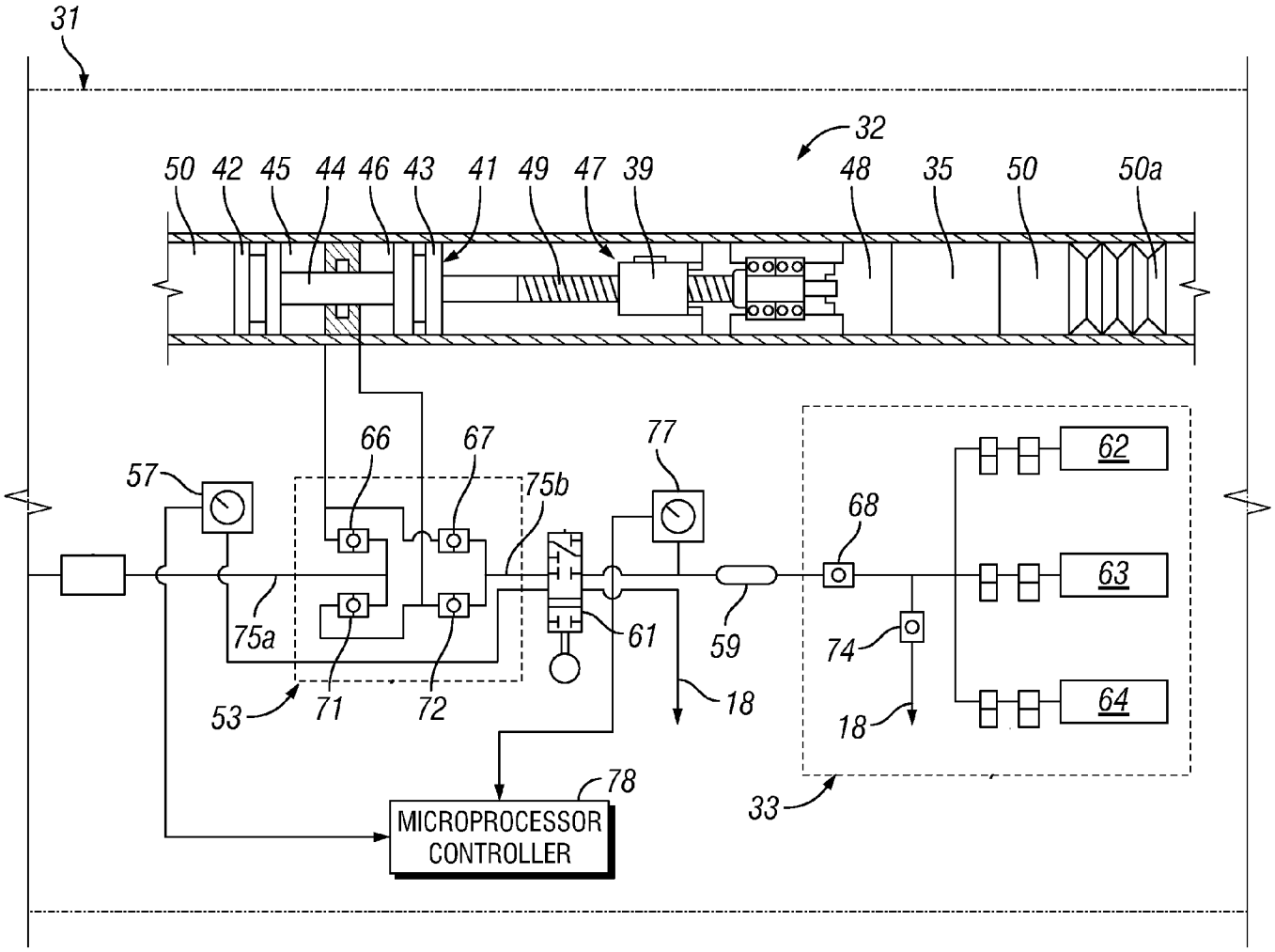
FIG. 3 is a schematic view of an apparatus according to one or more aspects of the present disclosure.

FIG. 3 is a schematic view of an apparatus illustrating an example of a positive displacement pump configured according to one or more aspects of the present disclosure. The example of FIG. 3 may be representative of one or more of the LWD tool 140 (FIG. 1), and/or the formation sampling tool 214 (FIG. 2). The apparatus of FIG. 3 may be used during the drilling, tripping, or wireline operation. The apparatus of FIG. 3 may be conveyed in a borehole with any method of conveyance, such as, for example, coil-tubing, wired/unwired drill pipe, wireline cable, or any combination thereof.

FIG. 3 shows a tester tool 31 that includes a pump module 32. A positive displacement pump 41 may include two pistons 42, 43 connected by a shaft 44 and disposed within corresponding pump chambers 45, 46 respectively. The pump chambers 45, 46 may be cylindrical chambers configured to accumulate a volume of fluid extracted from/injected into a subterranean formation or device. The dual piston 42, 43/pump chamber 45, 46 arrangement works through positive volume displacement. The dual piston 42, 43 motion, an axial reciprocation motion, is actuated via a planetary roller-screw 47, which is connected to a variable speed, electric pump motor 35 via a gearbox or transmission 48. The gearbox or transmission 48 is driven by the pump motor 35, and may be used to vary a transmission ratio between an output shaft of the pump motor 35 and a threaded shaft 49 of the planetary roller screw 47. The pump motor 35 may be part or integral to the positive displacement pump 41, but alternatively may be a separate component. Power to the pump motor 35 is supplied from a dedicated turbine (not shown) which drives an alternator (not shown). Gaps between the components of the pump module 32 are filled with oil 50 that may be pressure compensated with an annulus bellows compensator shown at 50*a*.

The pumping action of the positive displacement pump 41 is achieved via the planetary roller screw 47, which includes a nut 39, and the threaded shaft 49. The pump motor 35 and associated gearbox 48 drive the threaded shaft 49 in a bi-directional mode under the direction of a microprocessor controller, such as controller 78. During operation of the positive displacement pump 41, the fluid gets routed to either one of the two pump chambers 45 or 46. The positive displacement pump 41 operates such that there is one pump chamber 45 or 46 drawing fluid in from a fluid flow line 75*a*, while the other pump chamber 46 or 45, respectively, is expulsing fluid into a fluid flow line 75*b*. For example, a network 53 of mud check valves 66, 67, 71, and 72, acts as a fluid flow controller configured to control the flow of fluid between the pump chambers 45, 46 and the fluid flow lines 75*a* and 75*b*. During intake into the pump chamber 45, fluid passes from the fluid flow line 75*a*, into the network of mud check valves 53 and through the check valve 66, before entering the pump chamber 45. Upon output from the pump chamber 45, fluid passes into the network of mud check valves 53 and through the check valve 67, before entering the fluid flow line 75*b*. Similarly, upon intake into the chamber 46, fluid passes into the network of mud check valves 53 and through the check valve 71, before entering the pump chamber 46. Upon output from the pump chamber 46, fluid passes into the network of mud check valves 53 and through the check valve 72, before entering the fluid flow line 75*b*.

Then, the fluid pumped into flow line 75*b* may proceed, for example, to the fluid routing and equalization valve 61 where it is either expelled into a borehole (or borehole annulus) 18 or passed through an hydraulic/electrical connector 59, a check valve 68 and into one of the sample chambers 62-64 of a fluid sample collector module 33. The pumped fluid may also be expelled into the borehole 18 via check valve 74. However, those skilled in the art will appreciate that positive displacement pumps similar to the positive displacement pump 41 may be configured to inject fluid into the formation, produce fluid from the formation, inject fluid into another downhole tool/device, such as an inflatable packer, or any combination thereof. While only three sample chambers 62, 63, 64 are shown, it will also be noted that more or less than three chambers 62, 63, 64 may be employed. Those skilled in the art will appreciate that the number of chambers is not critical and the present disclosure is not limited to three chambers. Although FIG. 3 shows a network 53 of mud check valves, those skilled in the art will appreciate that the fluid flow controller may be any suitable configuration and number of components capable of directing the flow of fluid from the pump chambers 45, 46 to or from a fluid flow line 75. For example, a fluid flow controller may be made up of one or more solenoid valves.

In the present disclosure, the pressure sensors 57, 77 may be used to detect a failure mode of the positive displacement pump 41. The microprocessor controller 78 is operatively connected to the pressure sensors 57, 77. The microprocessor controller 78 includes functionality to obtain and analyze tool parameters and measurements, such as pressure measurements from the pressure sensors 57, 77. Alternatively or additionally, the microprocessor controller 78 may include functionality to obtain and analyze torque applied by the pump motor 35, load balance, current/voltage of the alternator, output flow rate, or any combination thereof. For example, with respect to FIG. 3, the microprocessor controller 78 is used to observe the pressure response measured by pressure sensors 57, 77 and automatically apply compensation when a failure mode of the positive displacement pump 41 is detected.

A failure mode of the positive displacement pump 41 may be any mode of operation of the positive displacement pump 41 that results in a change in the amount of volume of fluid produced/injected by the positive displacement pump corresponding to one stroke of the dual piston 42, 43. A failure mode may involve one or more of the fluid flow controller components being clogged in an open position. For example, one or more of the mud check valves 66, 67, 71, 72 may be in a failure mode when it is lodged open by a particle or due to erosion. In either case, one or more of the mud check valves 66, 67, 71, 72 (or any other component of a fluid flow controller) may not function properly, resulting, for example, in a reduced volume of fluid received from the flow line 75*a* into one or more of the pump chambers 45 and 46 when the volume of the corresponding one or more of the pump chambers 45 and 46 is increased (or sometimes fluid not flowing the flow line 75*a* into one or more of the pump chambers 45 and 46). The stroke of the pump piston 42, 43 corresponding to increasing the volume of the chamber while receiving the reduced volume of fluid into the chamber during a failure mode is hereinafter referred to as an inactive stroke. In contrast, the stroke corresponding to a pump chamber 45, 46 that continues to accumulate fluid is hereinafter referred to as the active stroke of the positive displacement pump 41. One or more of the mud check valves 66, 67, 71, 72 not functioning properly may additionally or alternatively result in a reduced volume of fluid expelled (or no fluid flow) from one or more of the pump chambers 45 and 46 into the flow line 75*b*, and/or a reduced volume of fluid pumped (or no fluid flow) from the flow line 75*a* into the flow line 75*b*.

Other examples of failure modes of the positive displacement pump 41 involve excessive sand accumulation in one or more of the pump chambers 45, 46. For example, during pumping, particles may be pumped through the formation sampling tool along with formation fluid and/or wellbore fluid. Sampling unconsolidated sand formation is common and may lead to a failure mode in which excessive sand is accumulated within one or both pump chambers 45, 46. As pumping progresses, sand accumulates to the point that one chamber volume is significantly reduced. As sand accumulates, the positive displacement pump 41 may require excessive power to complete a full stroke, resulting in sand particles becoming compacted.

Figure 4:
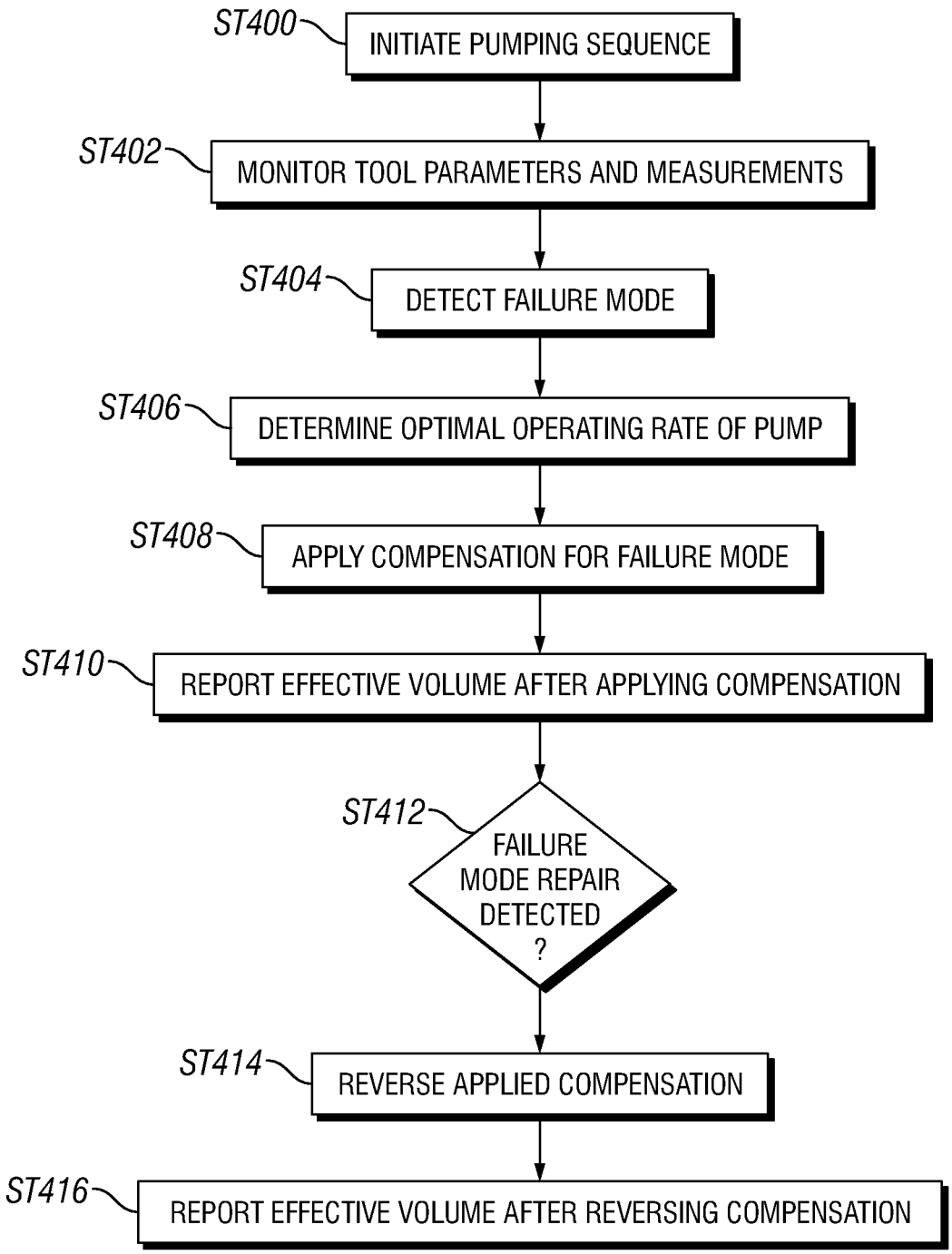
FIG. 4 is a flow-chart diagram of at least a portion of a method according to one or more aspects of the present disclosure.

FIG. 4 is a flow chart illustrating at least a portion of a method for detecting and applying compensation for a positive displacement pump failure mode according to one or more aspects of the present disclosure. One or more of the steps shown in FIG. 4 may be omitted, repeated, and/or performed in a different order than that shown in FIG. 4. Accordingly, the specific arrangement of steps shown in FIG. 4 should not be construed as limiting the scope of the present disclosure. The process of FIG. 4 may be implemented in conjunction with one or more downhole tools of, for example, a drill string and/or wireline tool(s) within the scope of the present disclosure.

To begin the example process of FIG. 4, the pumping sequence is started (ST 400). For example, under normal operation of the positive displacement pump, the pump piston, driven by a motor, begins its axial reciprocating motion, resulting in a first stroke and a second stroke in the reverse direction of the first stroke. The positive displacement pump may operate at a predetermined rate of pumping, in which both the first and second strokes are at a constant speed. For example, the operating rate of the positive displacement pump may be 5 cc/s. Each stroke of the positive displacement pump results in a volume of fluid accumulating in a corresponding pump chamber. For incompressible fluids, the volume produced by each stroke may be scaled to the piston displacement multiplied by the production area of the piston. The time for completing each stroke may be equal in both directions. That is, in Step 400, each stroke may be symmetric, and fluid is produced (or injected, depending on the function of the positive displacement pump) during each stroke direction at the predetermined operating rate of the positive displacement pump. Those skilled in the art will appreciate that the predetermined rate of the positive displacement pump during normal operation may be any suitable value, and depends on the properties of the fluid being pumped, the formation into or from which fluid is injected/extracted, and the operating capabilities of the positive displacement pump. Further, those skilled in the art will appreciate that the predetermined operating rate of the positive displacement pump may be at a maximum value during Step 400 based on the aforementioned considerations.

Next, tool parameters and measurements are monitored (ST 402). Tool parameters and measurements may include, but are not limited to, torque applied by the motor driving the positive displacement pump, pressure sensors, flow meter measurements, load balance, fluid mobility, etc. The aforementioned parameters and measurements may be monitored by a microprocessor located downhole and operatively connected to each of the sensors configured to measure parameters such as those described above.

At this stage in the process, a failure mode is detected from data received by one or more of the tools/sensors being monitored (ST 404). More specifically, the failure mode may be detected by, for example, observing a pattern in the pressure response, measured by a pressure sensor located at the pump inlet, between the first chamber and the second chamber. For example, the pattern observed may be a difference in pressure response between the first and second chambers. A pressure drop may be detected during a first stroke of the positive displacement pump corresponding to a first chamber, and an absence of a pressure drop may be detected during a second stroke of the positive displacement pump corresponding to a second chamber of the positive displacement pump (in a dual chamber positive displacement pump, for example). When the pressure response from one chamber is different from the other chamber, this may indicate that one of the chambers is not accumulating a same volume of fluid as another chamber, triggering a detection of a failure mode of the positive displacement pump. Similarly, a failure mode of the positive displacement pump may be detected by a load imbalance observed by observing the applied torque of a motor driving the positive displacement pump, a difference in piston displacement (for example, during a failure mode involving sand accumulation in one or more pump chambers), a difference in the observed input or output flow rate, a difference in the voltage/current measurements at the motor, or any suitable combination thereof.

Those skilled in the art will appreciate that detecting a failure mode (ST 404) may involve signal pattern recognition techniques that are well-known in the art. Such pattern recognition may be used, for example to formulate a pattern in the signal responses from the telemetric sensors of the downhole pump system and detect a break in the pattern, indicating a possible failure mode. Such pattern recognition techniques may be employed when measurement noise is large and/or non-stationary, and/or when the range of remedial actions become more complex. One such detection method may involve a correlation argument constructed by the following equations:

$$\chi_{t_o}(t) = \begin{cases} 1 & t - t_o \in [n\Delta t_p, (n+1)\Delta t_p] \\ 0 & t - t_o \in ((n+1)\Delta t_p, (n+2)\Delta t_p) \end{cases} \quad n = 0, 2, 4, \ldots \tag{1}$$

$$\Delta p(t) = \begin{cases} p_f - p(t) & t \geq t_o \\ 0 & t < t_o \end{cases} \tag{2}$$

$$A(k) = \int_{t_o}^{t_k} \Delta p(x) dx$$

$$t_k = t_o + k\Delta t_p,\ k = 0, 1, 2, \ldots$$

$$A_0(k) = \int_{t_o}^{t_k} \chi_{t_o}(x) \Delta p(x) dx$$

$$A_{-1}(k) = \int_{t_o}^{t_k} \chi_{t_o + \Delta t_p}(x) \Delta p(x) dx$$

The equations assume that each of the two strokes of the multi-chamber positive displacement pump takes the same duration $\Delta t_p$ and pumping starts at $t_0$. Thus, at $t_0$, pumping begins from one end of the stroke position of the positive displacement pump. The function $\chi_{t0}(t)$ is a function that helps identify the strokes in one direction versus the strokes in the opposite direction. As defined in equation 1, this function is equal to 1 at the times corresponding to the $1^{st}$, $3^{rd}$, $5^{th}$, etc., strokes (the stroke in a first direction), and is equal to 0 at the times corresponding to the $2^{nd}$, $4^{th}$, $6^{th}$ strokes (a stroke in a second direction reverse from the first direction). Line 1 of equation 2 is simply the computation of the "drawdown pressure": $p_f$ is the formation pressure (the pressure of the fluid in the formation pores), usually measured by performing a pretest before pumping (i.e., this value is already known when pumping begins), and p(t) is the pressure in the pump (measured by, for example, 57 in FIG. 3). So $\Delta p(t)$ is the "drawdown pressure", usually positive. Line 2 defines A(k) as the "total" area below the $\Delta p(t)$ curve measured between $t_0$ and until k stokes are performed. Line 3 defines $A_0(k)$ as the area below the $\Delta p(t)$ curve corresponding only to the strokes in one direction. Line 4 defines $A_{-1}(k)$ as the area below the $\Delta p(t)$ curve corresponding only to the strokes in the other direction.

Absent a failure mode, there should be no difference between the strokes in one direction and the other direction, so $A_0(k)$ should be similar to $A_{-1}(k)$ and equal to half of the total area A(k)/2. When a failure mode is present (e.g., a failure mode of one or more (but not all) components of a fluid flow controller), either $A_0(k)$ is similar to A(k) and $A_{-1}(k)$ is equal to zero, or $A_0(k)$ is equal to zero and $A_{-1}(k)$ is similar to A(k). When there is a complete failure (e.g., all components of a fluid flow controller are not functioning properly), $A_0(k)$, $A_{-1}(k)$, and A(k) are equal to zero.

The above set of equations and correlation argument assumes that the piston stroke length is constant; however, those skilled in the art will appreciate that modification of the term definitions may allow for variable stroke lengths. In addition, repairing of the failure mode (discussed below in ST 412) may also be detected using similar correlation relationships.

Continuing with FIG. 4, upon detection of a failure mode of the positive displacement pump, the optimal operating rate of the positive displacement pump for at least one of the active and the inactive strokes is determined (ST 406). Determining an optimal operating rate of the positive displacement pump may involve determining the maximum operating rate of the positive displacement pump for the active and inactive strokes by analyzing properties of the formation, pump parameters, and properties of the fluid being extracted/injected. All of these factors are considered when determining how fast the positive displacement pump should operate while avoiding motor burnout, damage to the formation, damage to the positive displacement pump, etc.

In ST 408, compensation is automatically applied for the detected failure mode. Compensation may be applied by a microprocessor located downhole (or on the surface) and operatively connected to the tool parameters and measurement sensors used to detect the failure mode. A variety of pump parameters may be adjusted to apply compensation for the failure mode, depending on the type of failure mode detected. For example, when the detected failure mode involves a clogged fluid flow controller, applying compensation may involve increasing the operating rate of the positive displacement pump for the inactive stroke. Those skilled in the art will appreciate that, in some cases, increasing the operating rate of the positive displacement pump for one stroke maybe be equivalent to reducing the stroke time of that stroke. Increasing the operating rate for the inactive stroke results in minimizing the time spent during the inactive pump stroke to achieve the maximum volumetric pump rate (i.e., the operating rate of the pump stroke that actually produces (or injects) fluid).

Those skilled in the art will appreciate that the present disclosure may assume that the positive displacement pump is operating at a maximum rate for at least the active stroke. In other words, it may be assumed that the pump rate for the active stroke is already at a maximum rate based on optimal fluid properties, formation characteristics, and operating characteristics of the positive displacement pump. In this case, applying compensation may involve changing the operating rate of the positive displacement pump for only the inactive stroke, as the inactive stroke is dead time that is not resulting in accumulation of fluid in a corresponding chamber. Those skilled in the art will further appreciate that the aforementioned method for applying compensation is most attractive when the operating rate of the positive displacement pump is slow (e.g., 0.1-1 cc/s), so that there is adequate ability to increase the pump rate of the inactive stroke. Alternatively, when the active stroke is not already at an optimal pump rate, applying compensation may involve changing the operating rate of the positive displacement pump for both the active and inactive strokes, while ensuring that, during the failure mode, the operating rate of the positive displacement pump for the inactive stroke is faster than that of the active stroke.

When the failure mode is a result of excessive sand accumulation in one or more of the chambers of the positive displacement pump, applying compensation may involve adjusting the stroke length of the positive displacement pump, and/or adjusting positions of the ends of strokes. Sand accumulation in a pump chamber reduces the displacement volume in the pump chamber by limiting the piston stroke length. Accordingly, an example of applying compensation for this failure mode may be to shorten the stroke length corresponding to the chamber that has excessive sand accumulation.

After compensation is applied, an accurate effective volume produced/injected by the positive displacement pump may be reported to the surface equipment (ST 410). For example, when compensation is applied, the production corresponding to the inactive stroke is reduced (or null), and the effective production rate is modified accordingly. Effective volume produced is an important calculation for contamination analysis and prediction of the time to reach a target contamination level when a flow rate metering device is not being used.

In ST 412, a determination is made as to whether repair of the failure mode is detected. More specifically, adjusting one or more pump parameters may result in repairing the detected failure mode. This repair may be detected in much the same manner that the failure mode is detected in ST 404. For example, when the operating rate of the positive displacement pump for the inactive stroke is increased, the speed at which the fluid is being discharged by the positive displacement pump may be high. In this case, the possibility of cleaning a clogged flow controller, for example, and repairing the failure mode is increased.

Next, the compensation applied in ST 408 may be reversed (ST 414). For example, using the same scenario described above, a clogged flow controller that is cleaned by the high speed of fluid moving through the positive displacement pump may result in decreasing the operating rate of the positive displacement pump for the active stroke. In this case, after applied compensation is reversed, the stroke time for both the active and inactive (which is now also active due to the repair of the failure mode) may be equal and constant, as during normal operation. When sand accumulation in a pump chamber is reduced, the stroke length corresponding to the chamber which now has less accumulated sand may be increased from the reduction in stroke length applied during the failure mode. Finally, the effective volume after reversing the applied compensation is reported (ST 416) to remain accurate in the amount of fluid volume produced/injected by the positive displacement pump. Effective volume amounts may be reported to tools/computing devices operating on the surface that collect data from downhole operations.

Figure 5:
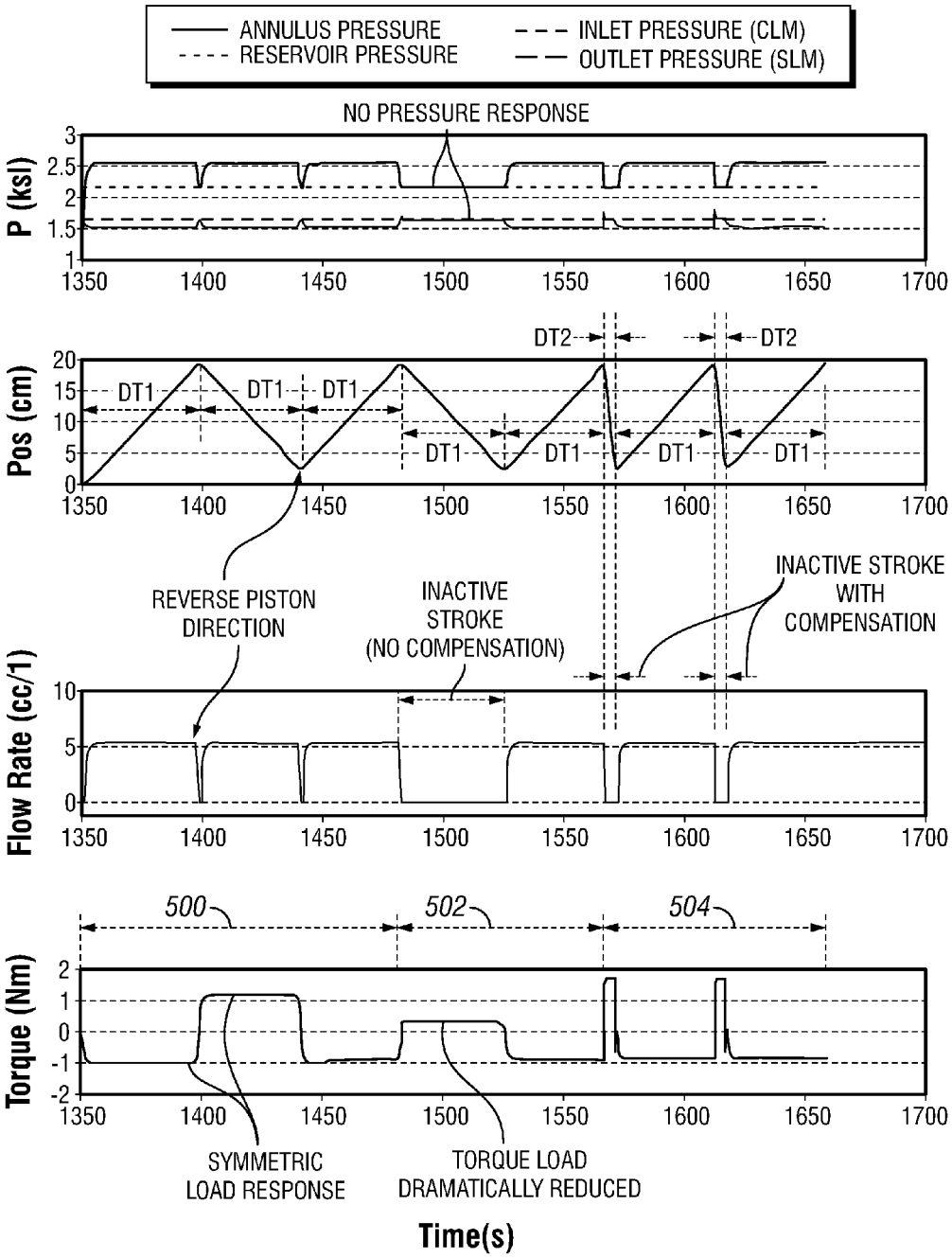
FIG. 5 shows an example of pumping operation according to one or more aspects of the present disclosure.

FIG. 5 is an example illustrating positive displacement pump operation with half-stroking occurring with subsequent compensation applied according to one or more aspects of the present disclosure. Specifically, FIG. 5 shows a simulated timing diagram in which a failure mode of the positive displacement pump starts during a pumping operation and subsequent compensation is applied. Specifically, the example timing diagram illustrates the effect of a failure mode on flowing pressures (a), pump piston displacement (b), output flow rate (c), and torque applied by the motor (d) driving the positive displacement pump. In this example, the operating rate of the positive displacement pump is commanded at 5 cc/s. The time between switching direction is denoted as dT1 and is equal for both stroke directions.

Normal pumping operation is shown from 1350-1475 seconds on each diagram in FIG. 5. During normal pumping operation (500), each stroke of the positive displacement pump is symmetric and fluid is produced (or injected) from/into the formation during each stroke direction at the predetermined operating rate of the positive displacement pump.

At 1475 seconds, when the failure mode occurs (502), the tool may not initially change behavior and continues at the commanded operating rate of the positive displacement pump. However, due to one of the two strokes of the piston being 'dead' (i.e., no volume of fluid accumulates in the corresponding chamber of the positive displacement pump), the normal curves of each of the parameters change. During the first stroke (the active stroke), for example in timing diagram (a), the pressure drops in response to producing fluid from the formation. During the reverse stroke (the inactive stroke), however, the pressure gauge does not show a response because of the failure mode (e.g., one of the check valves in the fluid flow controller is not functioning properly), and the pressure may remain constant and no formation load is realized. The pressure observed during the inactive stroke may match the formation pressure. Similarly, the output flow rate is zero at 1475 seconds in timing diagram (c), during the inactive stroke before compensation is applied. The torque applied by the motor in timing diagram (d) also shows that the torque load is dramatically reduced. In timing diagram (b), which is the displacement position of the piston, because the stroke time for the inactive stroke is still dT1, before compensation is applied, there is no change with respect to the displacement of the piston, as the piston moves at a constant rate during both strokes. In this scenario, the production rate of the positive displacement pump may be reduced by up to 50% if compensation is not applied. By observing one or more of the aforementioned changes in pump parameters and/or measurement sensor data, the failure mode is analyzed and detected (by a microprocessor controller operating downhole or on the surface) somewhere between 1475 and 150 seconds in FIG. 5.

At 1560 seconds, after the failure mode is analyzed and detected, compensation is applied (504). In this example, the tool automatically changes the operating rate of the positive displacement pump for the inactive stroke only. Thus, at 1560 seconds, compensation is automatically applied by increasing the operating rate of the positive displacement pump on the inactive stroke. However, as described above, other pump parameters may be modified, depending on the type of the failure mode and the properties of the positive displacement pump and the formation. When the operating rate of the positive displacement pump is changed, this also effectively reduces the stroke time for the inactive chamber cycle, which is minimized as much as possible. This minimized stroke time on the inactive stroke is shown as the piston recycle time dT2 in timing diagram (b), where dT2<<dT1. In other words, the time spent during the inactive pump stroke is minimized to achieve the maximum volumetric pump rate. The stroke time for the active chamber cycle remains at dT1. This may be because the positive displacement pump is already operating at its maximum operating rate on the active stroke. Alternatively, the stroke time for the active chamber cycle may also be increased, formation and pump properties permitting.

Those skilled in the art will appreciate that because the piston recycle time dT2 is relatively small, the speed of the fluid being discharged from the positive displacement pump may be high. Thus, this procedure of applying compensation is best performed with a properly configured discharge port.

While FIG. 5 is directed toward a failure mode of a fluid flow controller (e.g., mud check valves, solenoid valves, etc.), the same procedure may be applied to other types of failure modes. For example, the simulation shown in FIG. 5 may also be run for a failure mode of excessive sand accumulation in one or more pump chambers. Such a failure mode may be detected by monitoring the pumping pressure and other system sensors such as current, torque, piston displacement, etc.) to determine if the pump chamber volume is changing. Once this type of failure mode is detected, the system may automatically adjust the stroke length such that the pump drive is back within normal power range. The volume produced per pump stroke may be reduced. The system may report the new volumetric displacement of the system to remain accurate.

In view of the foregoing description and the figures, those skilled in the art should readily recognize that the present disclosure introduces a method, comprising detecting a failure mode of a fluid flow controller configured to control fluid flow between first and second chambers of a downhole positive displacement pump and a flow line of the fluid. The positive displacement pump operates in a first stroke during which a first volume of fluid accumulates in the first chamber, and a second stroke in a reverse direction from the first stroke during which a second volume of fluid accumulates in the second chamber. The method may further comprise automatically applying compensation for the failure mode to maximize fluid production by adjusting at least one parameter of the positive displacement pump.

The present disclosure also introduces a method of unclogging a fluid flow controller in a positive displacement pump that is in a failure mode as a result of being clogged in an open position. Unclogging the check valve may comprise adjusting an operating rate of the positive displacement pump so that the operating rate of a first stroke of the positive displacement pump is different from the operating rate of a second stroke of the positive displacement pump, resulting in passing fluid through the flow controller at an increased speed.

The present disclosure also introduces a method of detecting a failure mode of at least one of a plurality of check valves configured to control fluid flow between first and second chambers of a positive displacement pump and a fluid flow line, wherein, during the failure mode, only one of the first and second chambers corresponding to an active stroke of the positive displacement pump accumulates a volume of fluid. The method may further involve automatically switching, during the failure mode, to an increased operating rate of the positive displacement pump for an inactive stroke of the positive displacement pump.

The present disclosure also introduces a method of detecting a failure mode of a downhole positive displacement pump resulting from excessive sand accumulation in at least one chamber of the pump, wherein the positive displacement pump operates in a first stroke during which a first volume of fluid accumulates in a first chamber, and a second stroke in a reverse direction from the first stroke during which a second volume of fluid accumulates in a second chamber. The method may further involve automatically reducing a stroke length of the positive displacement pump to compensate for the excess sand accumulation in the at least one chamber.

The present disclosure also introduces an apparatus comprising: a positive displacement pump for a downhole tool, the positive displacement pump being configured to produce fluid. The positive displacement pump comprises a first chamber for collecting a first volume of fluid pumped from the formation during a first stroke of the pump, a second chamber for collecting a second volume of fluid during a second stroke of the pump, the second stroke being in a reverse direction from the first stroke, and a fluid flow controller for controlling fluid flow between the first and second chambers and the formation. The apparatus may further include a microprocessor operative connected to the positive displacement pump for: automatically detecting a failure mode of the flow controller, and applying compensation for the failure mode to maximize fluid production by adjusting at least one parameter of the positive displacement pump.

The present disclosure also introduces a method comprising: detecting a failure mode of a fluid flow controller configured to control fluid flow between first and second chambers of a downhole positive displacement pump and a flow line, wherein the positive displacement pump comprises a piston moving in an axial reciprocating motion; and adjusting operation of the downhole positive displacement pump based on the detected failure mode such that the downhole positive displacement pump piston operates differently in different axial directions. The failure mode of the downhole positive displacement pump may result in a change in the amount of volume of fluid produced and/or injected by the downhole positive displacement pump corresponding to one stroke of the piston. The failure mode may comprise an inactive stroke of a chamber of the downhole positive displacement pump, in which fluid: does not enter the chamber or enters the chamber from an inadvertent source. Adjusting the operation of the downhole positive displacement pump may comprise increasing an operating rate of the positive displacement pump for the inactive stroke. The axial reciprocating motion of the downhole positive displacement pump may comprise: a first stroke during which a first volume of fluid accumulates in a first pump chamber; and a second stroke in a reverse direction from the first stroke during which a second volume of fluid accumulates in a second pump chamber. The piston may move at an essentially constant speed during one of the first and second strokes. Adjusting the operation of the downhole positive displacement pump may comprise operating the positive displacement pump during the first stroke differently from during the second stroke. Adjusting the operation of the downhole positive displacement pump may comprise increasing a stroke speed of the piston during one of the first and second strokes. Detecting the failure mode may comprise monitoring, using a microprocessor located downhole, a plurality of downhole sensors and downhole tool parameters. Detecting the failure mode may comprise: measuring a pressure response to producing fluid from a subterranean formation during strokes of axially-opposite directions; and observing a pressure pattern in the pressure response of the strokes of axially-opposite directions. Detecting the failure mode may comprise: measuring a pressure response to producing fluid from a subterranean formation during strokes of axially-opposite directions; and observing a difference between pressure drops during the strokes of axially-opposite directions. Adjusting the operation of the downhole positive displacement pump may comprise adjusting operation automatically in response to receipt of at least one command from a surface tool by a microprocessor that is located downhole and is configured to control operation of the downhole positive displacement pump. The method may further comprise: detecting repair of the failure mode of the flow controller; and reversing the operation adjustment in response to the detected repair to essentially restore identical operation of the positive displacement pump during strokes of axially-opposite directions. The flow controller may comprise a network of check valves, and the failure mode may comprise at least one check valve being clogged in an open position. Operation of the downhole positive displacement pump may produce fluid from or inject fluid into a subterranean formation via the flow line, and adjusting operation of the downhole positive displacement pump may be performed while maintaining fluid communication between the flow line and the subterranean formation. The failure mode may comprise excessive sand accumulation in at least one chamber of the positive displacement pump. Adjusting the operation of the downhole positive displacement pump may comprise reducing a length of strokes in one of the first and second chambers. The method may further comprise conveying an apparatus, via wireline or drill string, in a borehole extending into a subterranean formation, wherein the apparatus comprises the fluid flow controller, the downhole positive displacement pump, and the flow line.

The present disclosure also introduces a method comprising: detecting a clogging of a fluid flow controller in a downhole positive displacement pump that is in a failure mode as a result of being clogged in an open position; and unclogging the fluid flow controller by adjusting an operating rate of the positive displacement pump so that the operating rate of a first stroke of the positive displacement pump is different from the operating rate of a second stroke of the positive displacement pump, resulting in passing fluid through the fluid flow controller at an increased speed, wherein: in the failure mode, the first stroke corresponds to fluid flowing from a flow line through the fluid flow controller into a first chamber of the downhole positive displacement pump; and in the failure mode, the second stroke corresponds to: fluid not flowing from the flow line through the flow controller into a second chamber of the positive displacement pump; or fluid flowing into the second chamber from an inadvertent source. The adjusted operating rate of the downhole positive displacement pump for the second stroke may be faster than for the first stroke. The method may further comprise: detecting an unclogging of the flow controller; and restoring the initial operating rate of the positive displacement pump for the second stroke upon detection of the unclogging of the fluid flow controller.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of the present disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising: a positive displacement pump for a downhole tool, wherein the positive displacement pump is operable to produce fluid from a flow line of the downhole tool, and wherein the positive displacement pump comprises: a first chamber disposed to receive a first volume of fluid during a first stroke of the positive displacement pump; a second chamber disposed to receive a second volume of fluid during a second stroke of the positive displacement pump, wherein the second stroke is in a reverse direction relative to the first stroke, and a fluid flow controller operable to control fluid flow between the first and second chambers and the flow line; and a processor operatively connected to the positive displacement pump and operable to: detect a failure mode of the fluid flow controller, and apply compensation for the failure mode by adjusting at least one parameter of the positive displacement pump; and wherein, during the failure mode, one but not both of the first and second chambers accumulates a volume of fluid from the flow line, resulting in an active stroke for the one of the first and second chambers and an inactive stroke for the other of the first and second chambers, and adjusting the at least one parameter comprises increasing an operating rate of the positive displacement pump for the inactive stroke.

2. The apparatus of claim 1 wherein the processor is operable to automatically detect the failure mode of the fluid flow controller.

3. The apparatus of claim 1 wherein the positive displacement pump is connected to a pipe string positioned in a borehole penetrating a subterranean formation.

4. The apparatus of claim 3 wherein the positive displacement pump produces fluid from the subterranean formation.

5. The apparatus of claim 1 wherein the fluid flow controller comprises a networked plurality of check valves.

6. The apparatus of claim 5 wherein the failure mode results from at least one of the networked plurality of check valves being clogged in an open position.

7. The apparatus of claim 1 further comprising a plurality of sensors each operatively connected to the processor and operable in the detection of the failure mode.

8. The apparatus of claim 7 wherein the plurality of sensors comprises a pressure sensor operable for measuring a pressure response to producing fluid from the flow line during the first and second strokes.

9. The apparatus of claim 8 wherein detecting the failure mode comprises observing a difference in the pressure response during the first and second strokes.

10. The apparatus of claim 7 wherein at least one of the plurality of sensors is operable for measuring at least one parameter selected from the group consisting of:

volumetric flow rate;
pump pressure;
fluid mobility;
applied torque; and
pump power.

11. The apparatus of claim 9 wherein the positive displacement pump comprises a piston, and wherein axial reciprocation of the piston defines the first and second strokes.

12. The apparatus of claim 11 wherein the piston comprises an electromechanically driven piston, a mechanically driven piston, or a hydraulically driven piston.

13. The apparatus of claim 9 further comprising a motor operable to apply torque to drive the positive displacement pump, wherein the processor is operable to monitor the torque applied by the motor to detect a load imbalance resulting from the failure mode.

14. The apparatus of claim 9 wherein the processor is operable to automatically apply the compensation by sending at least one command from a surface tool to the processor to control a pumping rate of the first and second strokes.

15. The apparatus of claim 9 wherein the apparatus is configured for conveyance in a borehole via a drill string.

* * * * *